US010774412B2

(12) United States Patent
Imai et al.

(10) Patent No.: US 10,774,412 B2
(45) Date of Patent: *Sep. 15, 2020

(54) HOT-DIP GALVANIZED COLD-ROLLED STEEL SHEET AND PROCESS FOR PRODUCING SAME

(75) Inventors: Norio Imai, Osaka (JP); Masayuki Wakita, Osaka (JP); Takuya Nishio, Osaka (JP); Jun Haga, Osaka (JP); Kengo Hata, Osaka (JP); Yasuaki Tanaka, Osaka (JP); Mitsuru Yoshida, Osaka (JP); Hiroshi Takebayashi, Osaka (JP); Suguhiro Fukushima, Osaka (JP); Toshiro Tomida, Osaka (JP)

(73) Assignee: NIPPON STEEL CORPORATION, Tokyo (JP)

( * ) Notice: Subject to any disclaimer, the term of this patent is extended or adjusted under 35 U.S.C. 154(b) by 1168 days.

This patent is subject to a terminal disclaimer.

(21) Appl. No.: 14/130,530

(22) PCT Filed: Jun. 29, 2012

(86) PCT No.: PCT/JP2012/066686

§ 371 (c)(1),
(2), (4) Date: Apr. 16, 2014

(87) PCT Pub. No.: WO2013/005670

PCT Pub. Date: Jan. 10, 2013

(65) Prior Publication Data

US 2014/0212686 A1 Jul. 31, 2014

(30) Foreign Application Priority Data

Jul. 6, 2011 (JP) ..... 2011-150249
Jul. 6, 2011 (JP) ..... 2011-150250

(51) Int. Cl.

| | |
|---|---|
| ***C21D 8/02*** | (2006.01) |
| ***C22C 38/12*** | (2006.01) |
| ***C22C 38/02*** | (2006.01) |
| ***C22C 38/06*** | (2006.01) |
| ***C22C 38/04*** | (2006.01) |
| ***C22C 38/00*** | (2006.01) |
| ***C21D 9/46*** | (2006.01) |
| ***C23C 2/02*** | (2006.01) |
| ***C23C 2/04*** | (2006.01) |

(52) U.S. Cl.

CPC ..... *C23C 2/02* (2013.01); *C21D 8/0236* (2013.01); *C21D 8/0263* (2013.01); *C21D 8/0273* (2013.01); *C22C 38/001* (2013.01); *C22C 38/02* (2013.01); *C22C 38/04* (2013.01); *C22C 38/06* (2013.01); *C22C 38/12* (2013.01); *C23C 2/04* (2013.01); *C21D 9/46* (2013.01); *C21D 2211/002* (2013.01); *C21D 2211/005* (2013.01); *C21D 2211/008* (2013.01); *Y10T 428/12799* (2015.01)

(58) Field of Classification Search
None
See application file for complete search history.

(56) References Cited

U.S. PATENT DOCUMENTS

| | | | | |
|---|---|---|---|---|
| 2002/0081452 | A1 | 6/2002 | Nakajima et al. | |
| 2007/0125456 | A1* | 6/2007 | Kochi | C22C 38/04 148/333 |
| 2008/0023112 | A1 | 1/2008 | Kashima | |
| 2010/0003541 | A1 | 1/2010 | Futamura et al. | |
| 2010/0307644 | A1 | 12/2010 | Gil Otin et al. | |
| 2013/0236350 | A1* | 9/2013 | Kakiuchi | C21D 8/0426 420/84 |

FOREIGN PATENT DOCUMENTS

| | | |
|---|---|---|
| CN | 101297051 | 10/2008 |
| EP | 1978113 | 10/2008 |
| JP | 58-123823 | 7/1983 |
| JP | 59-229413 | 12/1984 |
| JP | 11-061326 | 3/1999 |
| JP | 11-152544 | 6/1999 |
| JP | 2001-192768 | 7/2001 |

(Continued)

OTHER PUBLICATIONS

JP 2008-007854 machine translation.*
JP 2006-336074 machine translation.*
JP 2007-131910 machine translation (Year: 2007).*
JP 2006-274403 machine translation (Year: 2006).*
Langill. "Batch process hot dip galvanizing." ASM Handbooks vol. 13A. 2003. 794-802. (Year: 2003).*
Langill. "Batch process hot dip galvanizing." ASM Handbook. vol. 13A. 2003. 794-802. (Year: 2003).*
Liu et al., "Advanced run-out table cooling technology based on ultra fast cooling and laminar cooling in hot strip mill", J. Central South University Press, 2012, 19; 1341-1345.

(Continued)

*Primary Examiner* — Paul A Wartalowicz
*Assistant Examiner* — Stephani Hill
(74) *Attorney, Agent, or Firm* — Clark & Brody LP

(57) ABSTRACT

A hot-dip galvanized cold-rolled steel sheet has a tensile strength of 750 MPa or higher, a composition consisting, in mass percent, C: more than 0.10% and less than 0.25%, Si: more than 0.50% and less than 2.0%, Mn: more than 1.50% and 3.0% or less, and optionally containing one or more types of Ti, Nb, V, Cr, Mo, B, Ca, Mg, REM, and Bi, P: less than 0.050%, S: 0.010% or less, sol. Al: 0.50% or less, and N: 0.010% or less, and a main phase as a low-temperature transformation product and a second phase as retained austenite. The retained austenite volume fraction is more than 4.0% and less than 25.0% of the whole structure, and has an average grain size of less than 0.80 μm. A number density of retained austenite grains having a grain size of 1.2 μm or more is $3.0\times10^{-2}/\mu m^2$ or less.

7 Claims, No Drawings

(56) References Cited

FOREIGN PATENT DOCUMENTS

| | | | | | |
|---|---|---|---|---|---|
| JP | 2005-179703 | | | 7/2005 | |
| JP | 2005-336526 | | | 12/2005 | |
| JP | 2006274403 | A | * | 10/2006 | |
| JP | 2006-336074 | | | 12/2006 | |
| JP | 2007131910 | A | * | 5/2007 | |
| JP | 2008-007854 | | | 1/2008 | |
| JP | 2009-256773 | | | 11/2009 | |
| JP | 2010-059452 | | | 3/2010 | |
| JP | 2011-080126 | | | 4/2011 | |
| WO | 2007/015541 | | | 2/2007 | |
| WO | WO-2012067159 | A1 | * | 5/2012 | ..... C21D 8/0426 |
| WO | 2013/144376 | | | 10/2013 | |
| WO | 2013/144377 | | | 10/2013 | |

OTHER PUBLICATIONS

A. Fujibayashi et al., "JFE Steel's Advanced Manufacturing Technologies for High Performance Steel Plates", JFE Technical Report, No. 5, Mar. 2005.

* cited by examiner

HOT-DIP GALVANIZED COLD-ROLLED STEEL SHEET AND PROCESS FOR PRODUCING SAME

TECHNICAL FIELD

The present invention relates to a hot-dip galvanized cold-rolled steel sheet. More particularly, it relates to a high-strength hot-dip galvanized cold-rolled steel sheet that is excellent in ductility, work hardenability, and stretch flangeability, and a process for producing the same.

BACKGROUND ART

In these days when the industrial technology field is highly fractionalized, a material used in each technology field has been required to deliver special and high performance. For example, for a steel sheet that is press-formed and put in use, more excellent formability has been required with the diversification of press shapes. In addition, as a high strength has been required, the use of a high-strength steel sheet has been studied. In particular, concerning an automotive steel sheet, in order to reduce the vehicle body weight and thereby to improve the fuel economy from the perspective of global environments, a demand for a high-strength steel sheet having thin-wall high formability has been increasing remarkably. In press forming, as the thickness of steel sheet used is smaller, cracks and wrinkles are liable to occur. Therefore, a steel sheet further excellent in ductility and stretch flangeability is required. However, the press formability and the high strengthening of steel sheet are characteristics contrary to each other, and therefore it is difficult to satisfy these characteristics at the same time.

As a method for improving the press formability of a high-strength cold-rolled steel sheet, many techniques concerning grain refinement of micro-structure have been proposed. For example, Patent Document 1 discloses a method for producing a very fine grain high-strength hot-rolled steel sheet that is subjected to rolling at a total reduction of 80% or higher in a temperature range in the vicinity of $Ar_3$ point in the hot-rolling process. Patent Document 2 discloses a method for producing an ultrafine ferritic steel that is subjected to continuous rolling at a reduction of 40% or higher in the hot-rolling process.

By these techniques, the balance between strength and ductility of hot-rolled steel sheet is improved. However, the above-described Patent Documents do not at all describe a method for making a fine-grain cold-rolled steel sheet to improve the press formability. According to the study conducted by the present inventors, if cold rolling and annealing are performed on the fine-grain hot-rolled steel sheet obtained by high reduction rolling being a base metal, the crystal grains are liable to be coarsened, and it is difficult to obtain a cold-rolled steel sheet excellent in press formability. In particular, in the manufacturing of a composite-structure cold-rolled steel sheet containing a low-temperature transformation product or retained austenite in the metallurgical structure, which must be annealed in the high-temperature range of $Ac_1$ point or higher, the coarsening of crystal grains at the time of annealing is remarkable, and the advantage of composite-structure cold-rolled steel sheet that the ductility is excellent cannot be enjoyed.

Patent Document 3 discloses a method for producing a hot-rolled steel sheet having ultrafine grains, in which method, rolling reduction in the dynamic recrystallization region is performed with a rolling reduction pass of five or more stands. However, the lowering of temperature at the hot-rolling time must be decreased extremely, and it is difficult to carry out this method in a general hot-rolling equipment. Also, although Patent Document 3 describes an example in which cold rolling and annealing are performed after hot rolling, the balance between tensile strength and hole expandability is poor, and the press formability is insufficient.

Concerning the cold-rolled steel sheet having a fine structure, Patent Document 4 discloses an automotive high-strength cold-rolled steel sheet excellent in collision safety and formability, in which retained austenite having an average crystal grain size of 5 μm or smaller is dispersed in ferrite having an average crystal grain size of 10 μm or smaller. The steel sheet containing retained austenite in the metallurgical structure exhibits a large elongation due to transformation induced plasticity (TRIP) produced by the martensitizing of austenite during working; however, the hole expandability is impaired by the formation of hard martensite. For the cold-rolled steel sheet disclosed in Patent Document 4, it is supposed that the ductility and hole expandability are improved by making ferrite and retained austenite fine. However, the hole expanding ratio is at most 1.5, and it is difficult to say that sufficient press formability is provided. Also, to enhance the work hardening coefficient and to improve the collision safety, it is necessary to make the main phase a soft ferrite phase, and it is difficult to obtain a high tensile strength.

Patent Document 5 discloses a high-strength steel sheet excellent in elongation and stretch flangeability, in which the second phase consisting of retained austenite and/or martensite is dispersed finely within the crystal grains. However, to make the second phase fine to a nano size and to disperse it within the crystal grains, it is necessary to contain expensive elements such as Cu and Ni in large amounts and to perform solution treatment at a high temperature for a long period of time, so that the rise in production cost and the decrease in productivity are remarkable.

Patent Document 6 discloses a high-strength hot-dip galvanized steel sheet excellent in ductility, stretch flangeability, and fatigue resistance property, in which retained austenite and low-temperature transformation product are dispersed in ferrite having an average crystal grain size of 10 μm or smaller and in tempered martensite. The tempered martensite is a phase that is effective in improving the stretch flangeability and fatigue resistance property, and it is supposed that if grain refinement of tempered martensite is performed, these properties are further improved. However, in order to obtain a metallurgical structure containing tempered martensite and retained austenite, primary annealing for forming martensite and secondary annealing for tempering martensite and further for obtaining retained austenite are necessary, so that the productivity is impaired significantly.

Patent Document 7 discloses a method for producing a cold-rolled steel sheet in which retained austenite is dispersed in fine ferrite, in which method, the steel sheet is cooled rapidly to a temperature of 720° C. or lower immediately after being hot-rolled, and is held in a temperature range of 600 to 720° C. for 2 seconds or longer, and the obtained hot-rolled steel sheet is subjected to cold rolling and annealing.

CITATION LIST

Patent Document

Patent Document 1: JP 58-123823 A1
Patent Document 2: JP 59-229413 A1

Patent Document 3: JP 11-152544 A1
Patent Document 4: JP 11-61326 A1
Patent Document 5: JP 2005-179703 A1
Patent Document 6: JP 2001-192768 A1
Patent Document 7: WO2007/15541 A1

SUMMARY OF INVENTION

The above-described technique disclosed in Patent Document 7 is excellent in that a cold-rolled steel sheet in which a fine grain structure is formed and the workability and thermal stability are improved can be obtained by a process in which after hot rolling has been finished, the work strain accumulated in austenite is not released, and ferrite transformation is accomplished with the work strain being used as a driving force.

However, due to needs for higher performance in recent years, a hot-dip galvanized cold-rolled steel sheet provided with a high strength, good ductility, excellent work hardenability, and excellent stretch flangeability at the same time has been demanded.

The present invention has been made to meet such a demand. Specifically, an objective of the present invention is to provide a high-strength hot-dip galvanized cold-rolled steel sheet which has excellent ductility, work hardenability and stretch flangeability, as well as a tensile strength of 750 MPa or higher, and a method for producing the same.

Means for Solving the Problem

As a result of extensive examination on the effects of the chemical compositions and production conditions on the mechanical properties of the high-strength hot-dip galvanized cold-rolled steel sheet, the present inventors have eventually obtained the following findings shown in (A) to (G).

(A) If the hot-rolled steel sheet, which is produced through a so-called immediate rapid cooling process where rapid cooling is performed by water cooling immediately after hot rolling, specifically, the hot-rolled steel sheet is produced in such a way that the steel is rapidly cooled to the temperature range of 720° C. or lower within 0.40 second after the completion of hot rolling, is cold-rolled and annealed, the ductility and stretch flangeability of cold-rolled steel sheet are improved with the rise in annealing temperature. However, if the annealing temperature is too high, the austenite grains are coarsened, and the ductility and stretch flangeability of annealed steel sheet may be deteriorated abruptly.

(B) When the final rolling reduction of hot rolling is increased, the coarsening of austenite grains, which may possibly occur when annealing is performed at a high temperature after cold rolling, is restrained. Although the reason thereof is not clear, it is presumably attributable to the facts that (a) as the final rolling reduction increases, the ferrite fraction increases and the ferrite grains are refined in the metallurgical structure of hot-rolled steel sheet, (b) as the final rolling reduction increases, a coarse low-temperature transformation product decreases in the metallurgical structure of hot-rolled steel sheet, (c) since a ferrite grain boundary functions as a nucleation site in the transformation from ferrite to austenite during annealing, as the amount of fine ferrite increases, the frequency of nucleation increases and the austenite grains are refined, and (d) a coarse low-temperature transformation product transforms into a coarse austenite grain during annealing.

(C) When coiling temperature is increased in a coiling step after immediate rapid cooling, the coarsening of austenite grains which may possibly occur when annealing is performed at a high temperature after cold rolling is restrained. Moreover, when a hot-rolled steel sheet which has been coiled at a lowered coiling temperature in the coiling step after immediate rapid cooling is annealed in a temperature range of 500° C. or higher and $Ac_1$ point or lower, and thereafter is cold rolled and annealed at a high temperature, the coarsening of austenite grains is restrained as well. Although the reason thereof is not clear, it is presumably attributable to the facts that (a) since the grains of the hot-rolled steel sheet are refined due to immediate rapid cooling, the amount of precipitation of iron carbide in the hot-rolled steel sheet will remarkably increase as the coiling temperature rises, or as a result of the coiling at a lower temperature after immediate rapid cooling, fine martensitic structure is formed in the metallurgical structure, and as a result of the hot-rolled steel sheet being further annealed, fine iron carbides precipitate into the metallurgical structure, (b) since iron carbide acts as a nucleation site in the transformation from ferrite to austenite during annealing, as the amount of precipitation of iron carbide increases, the frequency of nucleation increases, and the austenite grains are refined, and (c) since undissolved iron carbide suppresses the grain growth of austenite, the austenite grains are refined.

(D) As the Si content in steel increases, the effect of preventing the coarsening of austenite grains is enhanced. Although the reason thereof is not clear, it is presumably attributable to the facts that (a) as the Si content increases, the grain of iron carbide becomes fine and the number density thereof increases, (b) as a result of this, the frequency of nucleation in the transformation from ferrite to austenite further increases, and (c) the grain growth of austenite is further restrained due to an increase in undissolved iron carbide, and the austenite grains are further refined.

(E) If the steel sheet is soaked at a high temperature while the coarsening of austenite grains is restrained and is cooled, a metallurgical structure is obtained in which the main phase is a fine low-temperature transformation product, the second phase contains fine retained austenite.

(F) As a result of restraining the formation of coarse retained-austenite grains whose grain size is 1.2 μm or more, the strechflangeability of a steel sheet whose main phase is a low-temperature transformation product is improved. Although the reason thereof is not clear, it is presumably attributable to the facts that (a) although retained austenite is transformed into hard martensite by press working, if the retained-austenite grain is coarse, the martensite grain also becomes coarse, causing an increase in stress concentration so that a void readily occurs at an interface with the parent phase and acts as a starting point of crack, and (b) since a coarse retained-austenite grain transforms into martensite in an early stage of press working, it is more likely to act as a starting point of crack than a fine retained-austenite grain is.

(G) As annealing temperature increases, the fraction of low-temperature transformation product increases and work hardenability tends to deteriorate; however, by restraining the formation of coarse retained-austenite grains having a grain size of 1.2 μm or more, it is possible to prevent the deterioration of work hardenability in a steel sheet whose main phase is low-temperature transformation product. Although the reason thereof is not clear, it is presumably attributable to the facts that (a) since a coarse retained-austenite grain transforms into martensite in an early stage of press working in which strain is less than 5%, it seldom contributes to an increase in n-value at strain of 5 to 10%, and (b) when the formation of coarse retained-austenite grains is restrained, fine retained-austenite grains, which transform into martensite in a high strain range of 5% or more, increase.

From the results described so far, it has been found that by subjecting a steel containing a fixed amount or more of Si to hot rolling at a raised final rolling reduction and thereafter to immediate rapid cooling, and either coiling it at a high temperature or coiling it at a low temperature, subjecting it to hot-rolled sheet annealing at a predetermined temperature and thereafter to cold rolling, and further subjecting it to annealing at a high temperature and thereafter to cooling, it is possible to obtain a hot-dip galvanized cold-rolled steel sheet which is excellent in ductility, work hardenability, and stretch flangeability and which has a metallurgical structure in which a main phase is a low-temperature transform ation product and a second phase includes retained austenite, which has a small amount of coarse retained-austenite grains having a grain size of 1.2 or more.

The present invention is a hot-dip galvanized cold-rolled steel sheet having a hot-dip galvanized layer on a surface of a cold-rolled steel sheet, wherein the cold-rolled steel sheet has: a chemical composition consisting, in mass percent, of C: more than 0.10% and less than 0.25%, Si: more than 0.50% and less than 2.0%, Mn: more than 1.50% and at most 3.0%, P: less than 0.050%, S: at most 0.010%, sol. Al: at least 0% and at most 0.50%, N: at most 0.010%, Ti: at least 0% and less than 0.040%, Nb: at least 0% and less than 0.030%, V: at least 0% and at most 0.50%, Cr: at least 0% and at most 1.0%, Mo: at least 0% and less than 0.20%, B: at least 0% and at most 0.010%, Ca: at least 0% and at most 0.010%, Mg: at least 0% and at most 0.010%, REM: at least 0% and at most 0.050%, Bi: at least 0% and at most 0.050%; and the remainder being Fe and impurities and by having a metallurgical structure in which a main phase is a low-temperature transformation product and a second phase contains retained austenite, wherein the retained austenite has a volume fraction of more than 4.0% to less than 25.0% with respect to the whole structure, and an average grain size of less than 0.80 μm, and in the retained austenite, a number density of retained austenite grains having a grain size of 1.2 μm or more is $3.0\times10^{-2}$ $\mu m^2$ or less.

The above described chemical composition preferably contains at least one element selected from the following groups (% is mass %):

(a) one or more types selected from a group consisting of Ti: at least 0.005% and less than 0.040%, Nb: at least 0.005% and less than 0.030%, and V: at least 0.010% and at most 0.50%;

(b) one or more types selected from a group consisting of Cr: at least 0.20% and at most 1.0%, Mo: at least 0.05% and less than 0.20%, and B: at least 0.0010% and at most 0.010%, and (c) one or more types selected from a group consisting of Ca: at least 0.0005% and at most 0.010%, Mg: at least 0.0005% and at most 0.010%, REM: at least 0.0005% and at most 0.050%, and Bi: at least 0.0010% and at most 0.050%.

A hot-dip galvanized cold-rolled steel sheet using as a base material a cold-rolled steel sheet having a metallurgical structure in which a main phase is a low-temperature transformation product and a second phase contains retained austenite, relating to the present invention can be produced by either of the following production method 1 or 2:

[Production method 1] A method including the following steps (A) to (D):

(A) a hot-rolling step in which a slab having the above described chemical composition is subjected to hot rolling in which a reduction of final one pass is more than 15% and rolling is completed in a temperature range of ($Ar_3$ point+30° C.) or higher, and higher than 880° C. to form a hot-rolled steel sheet, and the hot-rolled steel sheet is cooled to a temperature range of 720° C. or lower within 0.40 seconds after the completion of the rolling, and is coiled in a temperature range of higher than 400° C.;

(B) a cold-rolling step in which the hot-rolled steel sheet is subjected to a cold rolling to form a cold-rolled steel sheet;

(C) an annealing step in which the cold-rolled steel sheet is subjected to soaking treatment in a temperature range of higher than $Ac_3$ point, thereafter is cooled to a temperature range of 450° C. or lower and 340° C. or higher, and is held in the same temperature range for 15 seconds or more; and (D) a hot-dip galvanizing step in which the cold-rolled steel sheet obtained by the annealing step is subjected to hot-dip galvanizing.

[Production method 2] A method including the following steps (a) to (e):

(a) a hot-rolling step in which a slab having the above described chemical composition is subjected to hot rolling in which a reduction of final one pass is more than 15% and rolling is completed in a temperature range of ($Ar_3$ point+30° C.) or higher, and higher than 880° C. to form a hot-rolled steel sheet, and the hot-rolled steel sheet is cooled to a temperature range of 720° C. or lower within 0.40 seconds after the completion of the rolling, and is coiled in a temperature range of lower than 200° C.;

(b) a hot-rolled sheet annealing step in which the hot-rolled steel sheet is subjected to annealing in a temperature range of 500° C. or higher, and lower than $Ac_1$ point;

(c) a cold-rolling step in which the hot-rolled steel sheet obtained by the hot-rolled sheet annealing step is subjected to cold rolling to form a cold-rolled steel sheet;

(d) an annealing step in which the cold-rolled steel sheet is subjected to soaking treatment in a temperature range of higher than $Ac_3$ point, thereafter is cooled to a temperature range of 450° C. or lower and 340° C. or higher, and is held in the same temperature range for 15 seconds or more; and (e) a hot-dip galvanizing step in which the cold-rolled steel sheet obtained by the annealing step is subjected to hot-dip galvanizing.

According to the present invention, a high-strength hot-dip galvanized cold-rolled steel sheet having sufficient ductility, work hardenability, and stretch flangeability, which can be used for working such as press forming, can be obtained. Therefore, the present invention can greatly contribute to the development of industry. For example, the present invention can contribute to the solution to global environment problems through the lightweight of automotive vehicle body.

DESCRIPTION OF EMBODIMENTS

The structure and chemical composition of a cold-rolled steel sheet in a hot-dip galvanized cold-rolled steel sheet relating to the present invention, and the rolling, annealing, and galvanizing conditions etc. in a production method which allows effective, stable, and economical production of the cold-rolled steel sheet and the hot-dip galvanized steel sheet will be described below in detail.

1. Metallurgical Structure

A cold-rolled steel sheet, which is the base material for plating of a hot-dip galvanized cold-rolled steel sheet relating to the present invention, has a metallurgical structure in which a main phase is a low-temperature transformation product and a second phase contains retained austenite, and in which the retained austenite has a volume fraction of more than 4.0% and less than 25.0% with respect to the whole structure, and an average grain size of less than 0.80 μm, and in the retained austenite, a number density of retained austenite grains having a grain size of 1.2 μm or more is $3.0\times10^{-2}/\mu m^2$ or less.

The main phase means a phase or structure in which the volume fraction is at the maximum, and the second phase means a phase or structure other than the main phase.

The term "low-temperature transformation product" refers to a phase and structure which is formed by low-temperature transformation such as those of martensite and bainite. Other than those mentioned, examples of the low-temperature transformation product include bainitic ferrite. Bainitic ferrite is distinguished from polygonal ferrite from that a dislocation density is high, and from bainite from that no iron carbide has precipitated within bainitic ferrite grains or at those boundaries. Bainitic ferrite refers to a so-called lathtype or plate-like bainitic ferrite and granular bainitic ferrite having a granular form. This low-temperature transformation product may include phases and structures of two or more types, specifically martensite and bainitic ferrite. When the low-temperature transformation product includes two or more types of phases and structures, a total of volume fractions of these phases and structures is assumed to represent the volume fraction of the low-temperature transformation product.

The reason why the metallurgical structure of the cold-rolled steel sheet which is the base material for plating is limited as described above will be described next. Here, a cold-rolled steel sheet implies both of the cold-rolled steel sheet which is formed by cold-rolling a hot-rolled steel sheet obtained by hot-rolling, and an annealed cold-rolled steel sheet which is thereafter subjected to annealing.

The reason why the inventive steel sheet is specified to have a structure in which the main phase is a low-temperature transformation product and the second phase contains retained austenite is that it is preferable for improving ductility, work hardenability, and stretch flangeability while maintaining tensile strength. If the main phase is polygonal ferrite which is not a low-temperature transformation product, it becomes difficult to ensure the tensile strength and strechflangeability.

The volume fraction of retained austenite with respect to the whole structure is specified to be more than 4.0% and less than 25.0%. When the volume fraction of retained austenite is 4.0% or less, ductility becomes insufficient, and when it is 25.0% or more, strechflangeability remarkably deteriorates. The volume fraction of retained austenite is preferably more than 6.0%. It is more preferably more than 8.0%, and particularly preferably more than 10.0%. On the other hand, when the volume fraction of retained austenite is excessive, the stretch flangeability will deteriorate. Therefore, the volume fraction of retained austenite is preferably less than 18.0%. It is more preferably less than 16.0%, and particularly preferably less than 14.0%.

The average grain size of retained austenite is let to be less than 0.80 μm. In a hot-dip galvanized steel sheet using as a base material a cold-rolled steel sheet having a metallurgical structure in which the main phase is a low-temperature transformation product and the second phase contains retained austenite, when the average grain size of the retained austenite is 0.80 μm or more, the ductility, work hardenability, and stretch flangeability thereof will remarkably deteriorate. The average grain size of retained austenite is preferably less than 0.70 μm, and more preferably less than 0.60 μm. Although the lower limit for the average grain size of retained austenite will not be particularly limited, in order to obtain fine grains of 0.15 μm or less, it is necessary to greatly increase the final reduction for hot rolling, leading to a remarkable increase in the production load. Therefore, the lower limit for the average grain size of retained austenite is preferably more than 0.15 μm.

In a hot-dip galvanized steel sheet using as a base material a cold-rolled steel sheet having a metallurgical structure in which the main phase is a low-temperature transformation product and the second phase contains retained austenite, when a large amount of coarse retained-austenite grains having a grain size of 1.2 μm or more are present, the work hardenability and stretch flangeability will be impaired even if the average grain size of retained austenite is less than 0.80 μm. Therefore, the number density of retained austenite grains having a grain size of 1.2 μm or more is let to be $3.0\times10^{-2}/\mu m^2$ or less. The number density of retained austenite grains having a grain size of 1.2 μm or more is preferably $2.0\times10^{-2}/\mu m^2$ or less. The number density is more preferably $1.8\times10^{-2}/\mu m^2$ or less, and is particularly preferably $1.6\times10^{-2}/\mu m^2$ or less.

To further improve the balance between ductility and stretch flangeability, the average carbon concentration of retained austenite is preferably 0.80% or more, and is more preferably 0.84% or more. On the other hand, when the average carbon concentration of retained austenite becomes excessive, the stretch flangeability will deteriorate. Therefore, the average carbon concentration of retained austenite is preferably less than 1.7%. The average carbon concentration is more preferably less than 1.6%, furthermore preferably less than 1.4%, and particularly preferably less than 1.2%.

To further improve the ductility and work hardenability, the second phase preferably contains polygonal ferrite besides retained austenite. The volume fraction of polygonal ferrite with respect to the whole structure is preferably more than 2.0%. On the other hand, when the volume fraction of polygonal ferrite becomes excessive, the stretch flangeability will deteriorate. Therefore, the volume fraction of polygonal ferrite is preferably less than 40.0%. The volume fraction of polygonal ferrite is more preferably less than 30%, further preferably less than 24.0%, particularly preferably less than 20.0%, and most preferably less than 18.0%.

To improve tensile strength and work hardenability, the low-temperature transformation product preferably contains martensite. In this case, the volume fraction of martensite with respect to the whole structure is preferably more than 1.0%, and is further preferably more than 2.0%. On the other hand, when the volume fraction of martensite becomes excessive, the stretch flangeability will deteriorate. For this reason, the volume fraction occupied by martensite in the whole structure is preferably less than 15.0%. The volume fraction of martensite is more preferably less than 10.0%, particularly preferably less than 8.0%, and most preferably less than 6.0%.

The metallurgical structure of a cold-rolled steel sheet, which is the base material for a hot-dip galvanized cold-rolled steel sheet relating to the present invention, is measured as follows. That is, the volume fractions of the low-temperature transformation product and the polygonal ferrite are determined such that a specimen is taken from a hot-dip galvanized steel sheet, a longitudinal cross section in parallel with the rolling direction is polished and is subjected to Nital etching, and thereafter the metallurgical structure is observed using SEM at a position of a depth of ¼ sheet thickness from the surface of steel sheet (the interface between the plated surface and the steel sheet as the base material, the same rule applies to the following) to measure the area ratios of the low-temperature transformation product and the polygonal ferrite by image processing and to determine respective volume fractions assuming that the area ratio is equal to the volume fraction.

The volume fraction and the average carbon concentration of retained austenite are determined such that a specimen is taken from a hot-dip galvanized steel sheet, a rolled surface is chemically polished from the surface of steel sheet to a position of a depth of ¼ sheet thickness, and X-ray diffraction intensity and a diffraction angle are respectively measured by using XRD.

The grain size of retained austenite and the average grain size of retained austenite are measured as described below. A test specimen is sampled from the hot-dip galvanized steel sheet, and the longitudinal cross sectional surface thereof parallel to the rolling direction is electropolished. The metallurgical structure is observed at a position deep by one-fourth of thickness from the surface of steel sheet by using a SEM equipped with an EBSP analyzer. A region that is observed as a phase consisting of a face-centered cubic lattice structure (fcc phase) and is surrounded by the parent phase is defined as one retained austenite grain. By image processing, the number density (number of grains per unit area) of retained austenite grains and the area fractions of individual retained austenite grains are measured. From the areas occupied by individual retained austenite grains in a visual field, the circle corresponding diameters of individual retained austenite grains are determined, and the mean value thereof is defined as the average grain size of retained austenite.

In the structure observation using the EBSP, in the region having a size of 50 μm or larger in the sheet thickness direction and 100 μm or larger in the rolling direction, electron beams are applied at a pitch of 0.1 μm to make judgment of phase. Among the obtained measured data, the data in which the confidence index is 0.1 or more are used for grain size measurement as effective data. Also, to prevent the grain size of retained austenite from being undervalued by measurement noise, only the retained austenite grains each having a circle corresponding diameter of 0.15 μm or larger is taken as effective grains, whereby the average grain size is calculated.

In the present invention, the above-described metallurgical structure is defined at a position deep by one-fourth of thickness of steel sheet, which is a base material, from the boundary between the base material steel sheet and a plating layer.

As mechanical properties which can be realized based on the characteristics of the metallurgical structure described so far, the hot-dip galvanized cold-rolled steel sheet relating to the present invention has, to ensure shock absorbing property, a tensile strength (TS) in a direction perpendicular to the rolling direction of preferably 750 MPa or more, more preferably 850 MPa or more, and particularly preferably 950 MPa or more. On the other hand, to ensure ductility, the TS is preferably less than 1180 MPa.

When the value obtained by converting the total elongation ($El_0$) in the direction perpendicular to the rolling direction into a total elongation corresponding to the sheet thickness of 1.2 mm based on formula (1) below is taken as El, the work hardening coefficient calculated by using the nominal strains of two points of 5% and 10% with the strain range being made 5 to 10% in conformity to Japanese Industrial Standards JIS Z2253 and the test forces corresponding to these strains is taken as n-value, and the hole expanding ratio measured in conformity to Japan Iron and Steel Federation Standards JFST1001 is taken as λ, from the viewpoint of press formability, it is preferable that the value of TS×El be 18,000 MPa % or higher, the value of TS×n-value be 150 MPa or higher, the value of $TS^{1.7}\times\lambda$ be 4,500,000 $MPa^{1.7}$% or higher, and the value of $(TS\times El)\times 7\times 10^3+(TS^{1.7}\times\lambda)\times 8$ be $180\times 10^6$ or higher.

$$El=El_0\times(1.2/t_0)^{0.2} \quad (1)$$

in which $El_0$ is the actually measured value of total elongation measured by using JIS No. 5 tensile test specimen, $t_0$ is the thickness of JIS No. 5 tensile test specimen used for measurement, and El is the converted value of total elongation corresponding to the case where the sheet thickness is 1.2 mm.

TS×El is an index for evaluating ductility from the balance between strength and total elongation, TS×n-value is an index for evaluating work hardenability from the balance between strength and a work hardening coefficient, and $TS^{1.7}\times\lambda$ is an index for evaluating hole expandability from the balance between strength and a hole expanding ratio. $(TS\times El)\times 7\times 10^3+(TS^{1.7}\times\lambda)\times 8$ is an index for evaluating formability which is a combined property of elongation and hole expandability, a so-called stretch flangeability.

It is further preferable that the value of TS×El is 20000 MPa or more, the value of TS×n-value is 160 MPa or more, the value of $TS^{1.7}\times\lambda$ is 5500000 $MPa^{1.7}$% or more, and the value of $(TS\times El)\times 7\times 10^3+(TS^{1.7}\times\lambda)\times 8$ is $190\times 10^6$ or more. Particularly preferably, the value of $(TS\times El)\times 7\times 10^3+(TS^{1.7}\times\lambda)\times 8$ is $200\times 10^6$ or more.

Since the strain occurring when an automotive part is press-formed is about 5 to 10%, the work hardening coefficient was expressed by n-value for the strain range of 5 to 10% in the tensile test. Even if the total elongation of steel sheet is large, the strain propagating property in the press forming of automotive part is insufficient when the n-value is low, and defective forming such as a local thickness decrease occurs easily. From the viewpoint of shape fixability, the yield ratio is preferably lower than 80%, further preferably lower than 75%, and still further preferably lower than 70%.

2. Chemical Composition of Steel

C: more than 0.10% and less than 0.25%

If the C content is 0.10% or less, it is difficult to obtain the above-described metallurgical structure. Therefore, the C content is made more than 0.10%. The C content is preferably more than 0.12%, further preferably more than 0.14%, and still further preferably more than 0.16%. On the other hand, if the C content is 0.25% or more, not only the stretch flangeability of steel sheet is impaired, but also the weldability is deteriorated. Therefore, the C content is made less than 0.25%. The C content is preferably 0.23% or less, further preferably 0.21% or less, and still further preferably less than 0.19% or less. Si: more than 0.50% and less than 2.0%

Silicon (Si) has a function of improving the ductility, work hardenability, and stretch flangeability through the restraint of austenite grain growth during annealing. Also, Si is an element that has a function of enhancing the stability of austenite and is effective in obtaining the above-described metallurgical structure. If the Si content is 0.50% or less, it is difficult to achieve the effect brought about by the above-described function. Therefore, the Si content is made more than 0.50%. The Si content is preferably more than 0.70%, further preferably more than 0.90%, and still further preferably more than 1.20%. On the other hand, if the Si content is 2.0% or more, the surface properties of steel sheet are deteriorated. Further, the platability is deteriorated remarkably. Therefore, the Si content is made less than 2.0%. The Si content is preferably less than 1.8%, further preferably less than 1.6%, and still further preferably less than 1.4%.

In the case where the later-described Al is contained, the Si content and the sol.Al content preferably satisfy formula (2) below, further preferably satisfy formula (3) below, and still further preferably satisfy formula (4) below.

$$Si+sol.Al>0.60 \quad (2)$$

$$Si+sol.Al>0.90 \quad (3)$$

$$Si+sol.Al>1.20 \quad (4)$$

in which, Si represents the Si content (mass %) in the steel, and sol.Al represents the content (mass %) of acid-soluble A1.

Mn: More than 1.50% and 3.0% or Less

Manganese (Mn) is an element that has a function of improving the hardenability of steel and is effective in obtaining the above-described metallurgical structure. If the Mn content is 1.50% or less, it is difficult to obtain the above-described metallurgical structure. Therefore, the Mn content is made more than 1.50%. The Mn content is preferably more than 1.60%, further preferably more than 1.80%, and still further preferably more than 2.0%. If the Mn content becomes too high, in the metallurgical structure of hot-rolled steel sheet, a coarse low-temperature transformation product elongating and expanding in the rolling direction is formed, coarse retained austenite grains increase in the metallurgical structure after cold rolling and annealing, and the work hardenability and stretch flangeability are deteriorated. Therefore, the Mn content is made 3.0% or less. The Mn content is preferably less than 2.70%, further preferably less than 2.50%, and still further preferably less than 2.30%.

P: Less than 0.050%

Phosphorus (P) is an element contained in the steel as an impurity, and segregates at the grain boundaries and embrittles the steel. For this reason, the P content is preferably as low as possible. Therefore, the P content is made less than 0.050% or less. The P content is preferably less than 0.030%, further preferably less than 0.020%, and still further preferably less than 0.015%.

S: 0.010% or Less

Sulfur (S) is an element contained in the steel as an impurity, and foams sulfide-base inclusions and deteriorates the stretch flangeability. For this reason, the S content is preferably as low as possible. Therefore, the S content is made 0.010% or less. The S content is preferably less than 0.005%, further preferably less than 0.003%, and still further preferably less than 0.002%.

Sol.Al: 0.50% or Less

Aluminum (Al) has a function of deoxidizing molten steel. In the present invention, since Si having a deoxidizing function like Al is contained, Al need not necessarily be contained. That is, the sol.Al content may be impurity level. In the case where sol.Al is contained for the purpose of promotion of deoxidation, 0.0050% or more of sol.Al is preferably contained. The sol.Al content is further preferably more than 0.020%. Also, like Si, Al is an element that has a function of enhancing the stability of austenite and is effective in obtaining the above-described metallurgical structure. Therefore, Al can be contained for this purpose. In this case, the sol.Al content is preferably more than 0.040%, further preferably more than 0.050%, and still further preferably more than 0.060%. On the other hand, if the sol.Al content is too high, not only a surface flaw caused by alumina is liable to occur, but also the transformation point rises greatly, so that it is difficult to obtain a metallurgical structure such that the main phase is a low-temperature transformation product. Therefore, the sol.Al content is made 0.50% or less. The sol.Al content is preferably less than 0.30%, further preferably less than 0.20%, and still further preferably less than 0.10%.

N: 0.010% or Less

Nitrogen (N) is an element contained in the steel as an impurity, and deteriorates the ductility. For this reason, the N content is preferably as low as possible. Therefore, the N content is made 0.010% or less. The N content is preferably 0.006% or less, further preferably 0.005% or less, and still further preferably 0.003% or less.

The steel sheet relating to the present invention may contain elements listed below as arbitrary elements.

One or more types selected from a group consisting of Ti: less than 0.040%, Nb: less than 0.030%, and V: 0.50% or less.

Ti, Nb, and V have effects of increasing work strain by suppressing recrystallization in a hot rolling process, thereby fining the structure of the hot-rolled steel sheet. Moreover, they have an effect of precipitating as carbide or nitride, thereby restraining the coarsening of austenite during annealing. Therefore, one or more types of those elements may be contained. However, even if those elements are excessively contained, effectiveness by the above described effects will be saturated, which is uneconomical. Not only that, the recrystallization temperature during annealing rises and thereby the metallurgical structure after annealing becomes non-uniform so that the stretch flangeability is impaired as well. Further, the amount of the precipitation of carbide or nitride increases, yield ratio increases, and shape freezing property deteriorates as well. Therefore, it is decided that the Ti content is less than 0.040%, the Nb content is less than 0.030%, and the V content is 0.50% or less. The Ti content is preferably less than 0.030%, and more preferably less than 0.020%; the Nb content is preferably less than 0.020%, and more preferably less than 0.012%; and the V content is preferably 0.30% or less, and more preferably less than 0.050%. Further, the value of Nb+Ti×0.2 is preferably less than 0.030%, and more preferably less than 0.020%.

To surely achieve the effect brought about by the above-described function, either of Ti: 0.005% or more, Nb: 0.005% or more, and V: 0.010% or more is preferably satisfied. In the case where Ti is contained, the Ti content is further preferably made 0.010% or more, in the case where Nb is contained, the Nb content is further preferably made 0.010% or more, and in the case where V is contained, the V content is further preferably made 0.020% or more.

One Kind or Two or More Kinds Selected from a Group Consisting of Cr: 1.0% or Less, Mo: Less than 0.20%, and B: 0.010% or Less Cr, Mo and B are elements that have a function of improving the hardenability of steel and are effective in obtaining the above-described metallurgical structure. Therefore, one kind or two or more kinds of these elements may be contained. However, even if these elements are contained excessively, the effect brought about by the above-described function saturates, being uneconomical. Therefore, the Cr content is made 1.0% or less, the Mo content is made less than 0.20%, and the B content is made 0.010% or less. The Cr content is preferably 0.50% or less, the Mo content is preferably 0.10% or less, and the B content is preferably 0.0030% or less. To more surely achieve the effect brought about by the above-described function, either of Cr: 0.20% or more, Mo: 0.05% or more, and B: 0.0010% or more is preferably satisfied.

One Kind or Two or More Kinds Selected from a Group Consisting of Ca: 0.010% or Less, Mg: 0.010% or Less, REM: 0.050% or Less, and Bi: 0.050% or Less Ca, Mg and REM each have a function of improve the stretch flangeability by means of the regulation of shapes of inclusions, and Bi also has a function of improve the stretch flangeability by means of the refinement of solidified structure. Therefore, one kind or two or more kinds of these elements may be contained. However, even if these elements are contained excessively, the effect brought about by the above-described function saturates, being uneconomical. Therefore, the Ca content is made 0.010% or less, the Mg content is made 0.010% or less, the REM content is made 0.050% or less, and the Bi content is made 0.050% or less. Preferably, the Ca content is 0.0020% or less, the Mg content is 0.0020% or less, the REM content is 0.0020% or less, and the Bi content is 0.010% or less. To more surely obtain above-described function, either of Ca: 0.0005% or more, Mg: 0.0005% or more, REM: 0.0005% or more, and Bi: 0.0010% or more is preferably satisfied. The REM means rare earth metals, and is a general term of a total of 17 elements of Sc, Y, and lanthanoids. The REM content is the total content of these elements.

3. Hot-Dip Galvanized Layer

Examples of the hot-dip galvanized layer include those formed by hot-dip galvanizing, alloyed hot-dip galvanizing, hot-dip aluminum galvanizing, hot-dip Zn—Al alloy galvanizing, hot-dip Zn—Al—Mg alloy galvanizing, and hot-dip Zn—Al—Mg—Si alloy galvanizing or the like. For example, when the galvanized layer is formed by alloyed hot-dip galvanizing, the Fe concentration in the galvanized film is 7% or more and 15% or less. Examples of the hot-dip Zn—Al alloy galvanizing include hot-dip Zn-5% Al alloy galvanizing and hot-dip Zn-55% Al alloy galvanizing.

The mass of deposit of plating film is not particularly limited, and may be the same as before. For example, it may be 25 g/m$^2$ or more and 200 g/m$^2$ or less per one side. When the plated layer is an alloyed hot-dip galvanized layer, the mass of deposit of plating film is preferably 25 g/m$^2$ or more and 60 g/m$^2$ or less per one side from the viewpoint of suppressing powdering.

For the purpose of further improving corrosion resistance and coatability, post processing of single or multiple layers selected from chromic acid treatment, phosphate treatment, silicate-type non-chromium chemical treatment, resin film coating, and the like may be applied after plating.

4. Production Method First, a cold rolled steel sheet is produced, which has the above described metallurgical structure and chemical composition, and which is used as a base material.

Specifically, a steel having the above-described chemical composition is melted by publicly-known means and thereafter is formed into an ingot by the continuous casting process, or is formed into an ingot by an optional casting process and thereafter is formed into a billet by a billeting process or the like. In the continuous casting process, to suppress the occurrence of a surface defect caused by inclusions, an external additional flow such as electromagnetic stirring is preferably produced in the molten steel in the mold. Concerning the ingot or billet, the ingot or billet that has been cooled once may be reheated and be subjected to hot rolling. Alternatively, the ingot that is in a high-temperature state after continuous casting or the billet that is in a high-temperature state after billeting may be subjected to hot rolling as it is, or by retaining heat, or by heating it auxiliarily. In this description, such an ingot and a billet are generally called a "slab" as a raw material for hot rolling.

To prevent austenite from coarsening, the temperature of the slab that is to be subjected to hot rolling is preferably made lower than 1250° C., further preferably made lower than 1200° C. The lower limit of the temperature of slab to be subjected to hot rolling need not be restricted specially, and may be any temperature at which hot rolling can be finished in a temperature range of ($Ar_3$ point+30° C.) or higher, and higher than 880° C. as described later.

Hot-rolling is completed in a temperature range of ($Ar_3$ point+30° C.) or higher, and higher than 880° C. to fine the structure of the hot-rolled steel sheet by causing austenite to transform after the completion of rolling. When the temperature at the completion of rolling is too low, a coarse low-temperature transformation product which extends in the rolling direction occurs in the metallurgical structure of the hot-rolled steel sheet so that a coarse austenite grain increases in the metallurgical structure after cold rolling and annealing, and thereby work hardenability and stretch flangeability become more likely to deteriorate. For this reason, the completion temperature of hot rolling is set to ($Ar_3$ point+30° C.) or higher, and higher than 880° C. The completion temperature is preferably ($Ar_3$ point+50° C.) or higher, more preferably ($Ar_3$ point+70° C.) or higher, and particularly preferably ($Ar_3$ point+90° C.) or higher. On the other hand, when completion temperature of rolling is too high, the accumulation of work strain becomes insufficient, making it difficult to make the structure of the hot-rolled steel sheet fine. For this reason, the completion temperature of hot rolling is preferably lower than 950° C., and more preferably lower than 920° C. Moreover, to mitigate the production load, it is preferable to increase the completion temperature of hot rolling, thereby decreasing the rolling load. From this viewpoint, the completion temperature of hot rolling is preferably ($Ar_3$ point+50° C.) or higher and higher than 900° C.

In the case where the hot rolling consists of rough rolling and finish rolling, to finish the finish rolling at the above-described temperature, the rough-rolled material may be heated at the time between rough rolling and finish rolling. It is desirable that by heating the rough-rolled material so that the temperature of the rear end thereof is higher than that of the front end thereof, the fluctuations in temperature throughout the overall length of the rough-rolled material at the start time of finish rolling are restrained to 140° C. or less. Thereby, the homogeneity of product properties in a coil is improved.

The heating method of the rough-rolled material has only to be carried out by using publicly-known means. For example, a solenoid type induction heating apparatus is provided between a roughing mill and a finish rolling mill, and the temperature rising amount in heating may be controlled based on, for example, the temperature distribution in the lengthwise direction of the rough-rolled material on the upstream side of the induction heating apparatus.

The reduction of hot rolling is set that the reduction of the final one pass is more than 15% in a sheet-thickness reduction rate. This is for increasing the amount of work strain to be introduced into austenite, thereby fining the metallurgical structure of hot-rolled steel sheet, restraining the founation of coarse retained-austenite grains in the metallurgical structure after cold-rolling and annealing, and fining polygonal ferrite. The reduction of the final one pass is preferably more than 25%, more preferably more than 30%, and particularly preferably more than 40%. When the reduction becomes too high, the rolling load increases and rolling becomes difficult. Therefore, the reduction of the final one pass is preferably less than 55%, and more preferably less than 50%. To decrease the rolling load, a so-called lubricated rolling may be performed in which rolling is performed by supplying rolling oil between the rolling-mill roll and the steel sheet to decrease the friction coefficient.

After hot rolling, the steel sheet is rapidly cooled to a temperature range of 720° C. or lower within 0.40 seconds after the completion of rolling. This is done for the purpose of suppressing the release of work strain introduced into austenite by rolling, making the austenite transform with work strain as a driving force, fining the structure of the hot-rolled steel sheet, restraining the formation of coarse retained-austenite grains in the metallurgical structure after cold rolling and annealing, and fining polygonal ferrite. The steel sheet is preferably rapidly cooled to a temperature range of 720° C. or lower within 0.30 seconds after the completion of rolling, and more preferably rapidly cooled to a temperature range of 720° C. or lower within 0.20 seconds after the completion of rolling.

As the temperature at which rapid cooling stops is lower, the structure of hot-rolled steel sheet is made finer. Therefore, it is preferable that the steel sheet be rapidly cooled to the temperature range of 700° C. or lower after the completion of rolling. It is further preferable that the steel sheet be rapidly cooled to the temperature range of 680° C. or lower after the completion of rolling. Also, as the average cooling rate during rapid cooling is higher, the release of work strain is restrained. Therefore, the average cooling rate during rapid cooling is made 400° C./s or higher. Thereby, the structure of hot-rolled steel sheet can be made still finer. The average cooling rate during rapid cooling is preferably made 600° C./s or higher, and further preferably made 800° C./s or higher. The time from the completion of rolling to the start of rapid cooling and the cooling rate during the time need not be defined specially.

The equipment for performing rapid cooling is not defined specially; however, on the industrial basis, the use of a water spraying apparatus having a high water amount density is suitable. A method is cited in which a water spray header is arranged between rolled sheet conveying rollers, and high-pressure water having a sufficient water amount density is sprayed from the upside and downside of the rolled sheet.

After the stopping of rapid cooling, a hot-rolled steel sheet is obtained via either of the following procedures:

(1) the steel sheet after the stopping of rapid cooling is coiled in a temperature range of higher than 400° C.; or (2) the steel sheet after the stopping of rapid cooling is coiled in a temperature range of lower than 200° C., and thereafter is annealed in a temperature range of 500° C. or higher, and lower than $Ac_1$ point.

In the above described embodiment of (1), the reason why the steel sheet is coiled in a temperature range of higher than 400° C. is that when the coiling temperature is 400° C. or lower, iron carbides will not precipitate sufficiently in the hot-rolled steel sheet so that coarse retained-austenite grains are formed and polygonal ferrite is coarsened in the metallurgical structure after cold rolling and annealing. The coiling temperature is preferably higher than 500° C., more preferably higher than 520° C., and particularly preferably higher than 550° C. On the other hand, when the coiling temperature is too high, ferrite is coarsened in the hot-rolled steel sheet, and coarse retained-austenite grains are formed in the metallurgical structure after the cold rolling and annealing. For this reason, the coiling temperature is preferably lower than 650° C., and more preferably lower than 620° C.

In the case of the above described embodiment of (2), the reason why the steel sheet is coiled in a temperature range of lower than 200° C., and the hot-rolled steel sheet is subjected to annealing in a temperature range of 500° C. or higher, and lower than $Ac_1$ point is that when the coiling temperature is 200° C. or higher, the formation of martensite will become insufficient. When the annealing temperature after the coiling is lower than 500° C., iron carbides will not precipitate sufficiently, and when the temperature is $Ac_1$ point or higher, ferrite will be coarsened, and coarse retained-austenite grains will be formed in the metallurgical structure after cold rolling and annealing.

In the case of the above described embodiment of (2), the hot-rolled steel sheet which has been hot-rolled and coiled is subjected to processing such as degreasing according to a known method as needed, and thereafter is annealed. The annealing applied to a hot-rolled steel sheet is referred to as hot-rolled sheet annealing, and the steel sheet after the hot-rolled sheet annealing is referred to as hot-rolled and annealed steel sheet. Before hot-rolled sheet annealing, descaling may be performed by acid pickling, etc. The holding time in the hot-rolled sheet annealing does not need to be specifically limited. Since a hot-rolled steel sheet produced via appropriate immediate rapid cooling process has a fine structure, it does not need to be retained for long hours. Since as the holding time becomes longer, the productivity deteriorates, the upper limit of the holding time is preferably less than 20 hours. The holding time is more preferably less than 10 hours, and particularly preferably less than 5 hours.

In either of the above described embodiments of (1) and (2), although conditions from the stopping of rapid cooling to the coiling will not be particularly specified, it is preferable that the steel sheet is held in a temperature range of 720 to 600° C. for 1 second or more after the stopping of rapid cooling. Retaining for 2 seconds or more is more preferable, and retaining for 5 seconds or more is particularly preferable. As a result of this, the formation of fine ferrite is facilitated. On the other hand, since when the holding time becomes too long, the productivity will be impaired, the upper limit of the holding time in a temperature range of 720 to 600° C. is preferably within 10 seconds. After the holding in the temperature range of 720 to 600° C., the steel sheet is preferably cooled to the coiling temperature at a cooling rate of 20° C./sec or higher to prevent the coarsening of ferrite that has been produced.

The hot-rolled steel sheet obtained through the procedure of (1) or (2) is descaled by acid pickling, etc., and thereafter is subjected to cold rolling according to a common procedure. Cold-rolling is performed preferably at a cold-rolling reduction rate (the reduction in cold rolling) of 40% or higher to facilitate recrystallization, thereby homogenizing the metallurgical structure after cold rolling and annealing, and further improving stretch flangeability. Since when the cold reduction rate is too high, the rolling load increases making the rolling difficult, the upper limit of cold reduction rate is preferably less than 70%, and more preferably less than 60%.

The cold-rolled steel sheet which has been obtained in cold-rolling process is subjected to processing such as degreasing as needed according to a known method, and thereafter is annealed. The lower limit of soaking temperature in annealing is set to higher than $Ac_3$ point. This is for obtaining a metallurgical structure in which the main phase is a low-temperature transformation product and the second phase contains retained austenite. However, when the soaking temperature becomes too high, austenite becomes excessively coarse, and the ductility, work hardenability, and stretch flangeability are likely to deteriorate. For this reason, the upper limit of soaking temperature is preferably less than ($Ac_3$ point+100° C.). The upper limit is more preferably less than ($Ac_3$ point+50° C.), and particularly preferably less than ($Ac_3$ point+20° C.).

Although the holding time (soaking time) at a soaking temperature does not need to be particularly limited, it is preferably more than 15 seconds, and more preferably more than 60 seconds to achieve stable mechanical properties. On the other hand, when the holding time becomes too long, austenite becomes excessively coarse so that the ductility, work hardenability, and stretch flangeability are likely to deteriorate. For this reason, the holding time is preferably less than 150 seconds, and more preferably less than 120 seconds.

In a heating procedure in annealing, a heating rate from 700° C. to a soaking temperature is preferably less than 10.0° C./sec to facilitate recrystallization and homogenize the metallurgical structure after annealing, further improving the stretch flangeability. The heating rate is further preferably less than 8.0° C./sec, and particularly preferably less than 5.0° C./sec.

In a cooling procedure after soaking in annealing, cooling is preferably performed at a cooling rate of 15° C./sec or higher through a temperature range of 650 to 500° C. to achieve a metallurgical structure in which the main phase is a low-temperature transformation product. It is more preferable to perform cooling at a cooling rate of 15° C./sec or higher through a temperature range of 650 to 450° C. Since the volume fraction of low-temperature transformation product increases as the cooling rate increases, the cooling rate is more preferably 20° C./sec or higher, and particularly preferably 40° C./sec or higher. On the other hand, since when the cooling rate is too high, the shape of steel sheet is impaired, the cooling rate in a temperature range of 650 to 500° C. is preferably 200° C./sec or lower. The cooling rate is further preferably less than 150° C./sec, and particularly preferably less than 130° C./sec.

When it is intended to facilitate the production of fine polygonal ferrite and improve the ductility and work hardenability, the steel sheet is preferably cooled by 50° C. or more from the soaking temperature at a cooling rate of lower than 5.0° C./sec. The cooling rate after soaking is more preferably lower than 3.0° C./sec. The cooling rate is particularly preferably lower than 2.0° C./sec. Moreover, to further increase the volume fraction of polygonal ferrite, the steel sheet is cooled preferably by 80° C. or more, more preferably by 100° C. or more, and particularly preferably by 120° C. or more from the soaking temperature at a cooling rate of lower than 5.0° C./sec.

Moreover, to ensure the amount of retained austenite, the steel sheet is held in a temperature range of 450 to 340° C. for 15 seconds or more. To improve the stability of retained austenite, thereby further improving the ductility, work hardenability, and stretch flangeability, the holding temperature range is preferably 430 to 360° C. Moreover, since as the holding time increases, the stability of retained austenite improves, the holding time is set to 30 seconds or more. The holding time is preferably 40 seconds or more, and more preferably 50 seconds or more. Since when the holding time is excessively long, not only the productivity is impaired, but also the stability of retained austenite rather declines, the holding time is preferably 500 seconds or less. The holding time is more preferably 400 seconds or less, particularly preferably 200 seconds or less, and most preferably 100 seconds or less.

Thus produced cold-rolled steel sheet which has been annealed is subjected to hot-dip galvanizing. In the hot-dip galvanizing, the cold-rolled steel sheet is treated up to the annealing step in the above described manner, and the steel sheet is reheated as needed, and thereafter is subjected to hot-dip galvanizing. As for the conditions for hot-dip galvanizing, conditions commonly applied depending on the kind of hot-dip galvanizing may be adopted.

When the hot-dip galvanizing is hot-dip galvanizing or hot-dip Zn—Al alloy galvanizing, the hot-dip galvanizing may be applied in a temperature range of 450° C. or higher and 620° C. or lower as with conditions performed in a common hot-dip galvanizing line such that a hot-dip galvanized layer or a hot-dip Zn—Al alloy galvanized layer is formed on the surface of steel sheet.

Moreover, after the hot-dip galvanizing treatment, galvannealing treatment for alloying the hot-dip galvanized layer may be applied. In this occasion, the Al concentration in the plating bath is preferably controlled to be 0.08 to 0.15%. There will be no problem even if the plating bath includes, besides Zn and Al, 0.1% or less of Fe, V, Mn, Ti, Nb, Ca, Cr, Ni, W, Cu, Pb, Sn, Cd, Sb, Si, and Mg. Moreover, the galvannealingtreatment temperature is preferably 470° C. or higher and 570° C. or lower. This is because, when the galvannealingtreatment temperature is lower than 470° C., the galvannealingrate will remarkably decline, and the time needed for the alloying treatment increases, thereby leading to a decline of productivity. Moreover, when the galvannealingtreatment temperature exceeds 570° C., the alloying rate in the plated layer remarkably increases, which may lead to an embrittlement of the alloyed hot-dip galvanized layer. The galvannealing-treatment temperature is more preferably 550° C. or lower. Since, after hot-dip galvanizing, mutual diffusion of elements occurs between the steel material and the molten metal at the time of dipping and cooling, the composition of the coated film on the surface of the cooled steel sheet will have a slightly higher Fe concentration than the composition of the plating bath. In the alloyed hot-dip galvanizing, which actively exploits such mutual diffusion, Fe concentration in the coated film will be 7 to 15%.

Although the mass of deposit of plating film is not particularly limited, generally, 25 to 200 $g/m^2$ per one side is preferable. In the case of alloyed hot-dip galvanizing, since there are concerns about powdering, the mass of deposit of plating film is preferably 25 to 60 $g/m^2$ per one side. Although hot-dip galvanizing is typically performed on both sides, it can be performed on one side as well.

Thus obtained hot-dip galvanized cold-rolled steel sheet may be subjected to temper rolling according to a common procedure. However, since a high elongation rate in temper rolling will lead to deterioration of ductility, the elongation rate in temper rolling is preferably 1.0% or less. More preferably, the elongation rate is 0.5% or less.

The hot-dip galvanized cold-rolled steel sheet may be subjected to chemical treatment which is well known to one skilled in the art to improve the corrosion resistance thereof. The chemical treatment is preferably performed by using a treatment solution which does not contain chromium. One example of such chemical treatment includes one which forms a siliceous film.

EXAMPLE

The present invention will be specifically described with reference to examples.

By using an experimental vacuum melting furnace, steels each having the chemical composition given in Table 1 were melted and cast. These ingots were formed into 30-mm thick billets by hot forging. The billets were heated to 1200° C. by using an electric heating furnace and held for 60 minutes, and thereafter were hot-rolled under the conditions given in Table 2.

To be specific, an experimental hot-rolling mill was used to perform 6 passes of rolling in a temperature range of $Ar_3$ point+30° C. or higher, and higher than 880° C. so that the billet was finished into a thickness of 2 mm. The reduction of the final one pass was set to 11 to 42% in thickness reduction rate. After hot rolling, the steel was cooled to 650 to 720° C. at various cooling conditions by using a water spray, further allowed to naturally cool for 5 to 10 seconds, thereafter cooled to various temperatures at a cooling rate of 60° C./sec, and coiled at the respective temperatures. Excepting those whose coiling temperature was set to the room temperature, the steel was put into an electric heating furnace which was held at the coiling temperature and held for 30 minutes, thereafter was furnace cooled to the room temperature at a cooling rate of 20° C./h, thereby simulating slow cooling after coiling, to obtain a hot-rolled steel sheet. Moreover, those whose coiling temperature were set to the room temperature were, excepting some of them, heated from the room temperature to 600° C. which was a temperature range lower than $Ac_1$ point at a rate of temperature rise of 50° C./h, and thereafter was subjected to hot-rolled sheet annealing in which cooled to the room temperature at a cooling rate of 20° C./h.

The obtained hot-rolled steel sheet was subjected to acid pickling to be used as a base metal for cold-rolling, which was subjected to cold-rolling at a reduction of 50% to obtain a cold-rolled steel sheet having a thickness of 1.0 mm Using a continuous annealing simulator, the obtained cold-rolled steel sheet was heated to 550° C. at a heating rate of 10° C./sec, and thereafter was heated to various temperatures shown in Table 2 at a heating rate of 2° C./sec to be soaked for 95 seconds. Thereafter, the steel sheet was cooled to various primary cooling stop temperatures shown in Table 2 at a cooling rate of 2° C./sec; was cooled to various secondary cooling stop temperatures shown in Table 2 at a cooling rate of 40° C./sec; next, was held at the secondary cooling stop temperature for 60 to 330 seconds to perform heat treatment corresponding to an annealing step, and thereafter was subjected to heat treatment corresponding to dipping into a hot-dip galvanizing bath of 460° C. and heat treatment corresponding to galvannealing treatment at 500 to 520° C., and was cooled to the room temperature to obtain an annealed steel sheet which has gone through heat treatment corresponding to alloyed hot-dip galvanizing after annealing.

TABLE 1

| | Chemical composition (mass %) | | | | | | | | | $Ar_3$ | $Ac_3$ | |
|---|---|---|---|---|---|---|---|---|---|---|---|---|
| Steel | C | Si | Mn | P | S | sol. Al | N | Others | Si + Al | (° C.) | (° C.) | Remarks |
| A | 0.183 | 1.24 | 2.55 | 0.010 | 0.001 | 0.047 | 0.0029 | Nb: 0.011 | 1.287 | 750 | 840 | ○ |
| B | 0.181 | 1.27 | 2.25 | 0.009 | 0.001 | 0.051 | 0.0029 | Nb: 0.011 | 1.321 | 766 | 845 | ○ |
| C | 0.181 | 1.26 | 1.92 | 0.010 | 0.001 | 0.054 | 0.0033 | Nb: 0.010 | 1.314 | 782 | 860 | ○ |
| D | 0.180 | 1.23 | 1.89 | 0.009 | 0.001 | 0.052 | 0.0028 | Nb: 0.011 | 1.282 | 783 | 860 | ○ |
| E | 0.182 | 1.25 | 1.62 | 0.009 | 0.001 | 0.050 | 0.0029 | Nb: 0.011 | 1.300 | 796 | 870 | ○ |
| F | 0.179 | 1.27 | 2.23 | 0.009 | 0.001 | 0.048 | 0.0030 | | 1.318 | 767 | 840 | ○ |
| G | 0.197 | 1.26 | 1.92 | 0.009 | 0.001 | 0.14 | 0.0033 | Nb: 0.010 | 1.400 | 784 | 885 | ○ |
| H | 0.198 | 1.28 | 2.24 | 0.009 | 0.001 | 0.050 | 0.0033 | Nb0.011 | 1.330 | 762 | 845 | ○ |
| I | 0.159 | 1.47 | 2.59 | 0.010 | 0.001 | 0.050 | 0.0031 | | 1.520 | 761 | 855 | ○ |
| J | 0.174 | 1.47 | 1.89 | 0.009 | 0.001 | 0.059 | 0.0027 | Nb: 0.011 | 1.529 | 793 | 880 | ○ |
| K | 0.173 | 1.24 | 1.88 | 0.009 | 0.001 | 0.15 | 0.0027 | Nb: 0.012 | 1.39 | 794 | 880 | ○ |
| L | 0.179 | 1.23 | 1.89 | 0.010 | 0.001 | 0.050 | 0.0028 | Nb: 0.011 | 1.28 | 783 | 865 | ○ |
| M | 0.198 | 1.26 | 2.22 | 0.009 | 0.001 | 0.14 | 0.0031 | Nb: 0.011 | 1.400 | 769 | 870 | ○ |
| N | 0.180 | 1.26 | 2.49 | 0.009 | 0.001 | 0.051 | 0.0029 | Nb: 0.011 | 1.311 | 755 | 835 | ○ |
| O | 0.182 | 1.24 | 2.24 | 0.010 | 0.001 | 0.051 | 0.0031 | Ti: 0.013 | 1.291 | 769 | 835 | ○ |
| P | 0.178 | 1.26 | 1.83 | 0.009 | 0.001 | 0.046 | 0.0027 | Nb: 0.011, Cr: 0.13 | 1.306 | 786 | 860 | ○ |
| Q | 0.157 | 1.52 | 2.55 | 0.009 | 0.001 | 0.047 | 0.0029 | Bi: 0.004 | 1.567 | 771 | 855 | ○ |
| R | 0.178 | 1.25 | 2.26 | 0.010 | 0.001 | 0.049 | 0.0032 | Ca: 0.0007 Mg: 0.0006 | 1.299 | 773 | 840 | ○ |
| S | 0.154 | 1.48 | 2.58 | 0.009 | 0.001 | 0.045 | 0.0029 | Mo: 0.07 B: 0.0009 | 1.525 | 763 | 860 | ○ |
| T | 0.180 | 1.24 | 2.23 | 0.009 | 0.001 | 0.048 | 0.0027 | V: 0.08, REM: 0.0006 | 1.288 | 768 | 845 | ○ |
| U | 0.124 | 0.05* | 2.97 | 0.011 | 0.003 | 0.031 | 0.0041 | | 0.081 | 790 | 795 | x |
| V | 0.145 | 0.99 | 2.49 | 0.012 | 0.004 | 0.029 | 0.0048 | | 1.019 | 785 | 835 | ○ |
| W | 0.157 | 1.01 | 2.62 | 0.009 | 0.001 | 0.034 | 0.0032 | Nb: 0.010 | 1.044 | 830 | 830 | ○ |

Note)

Remarks: Symbol ○ indicates inventive example, symbol x indicates comparative example.

Symbol * indicates out of the scope of the present invention.

TABLE 2

| Test No. | Steel | Hot rolling conditions: Final pass reduction (%) | Rolling finish temperature (° C.) | Cooling time to 720° C. (s) | Average cooling rate from rapid cooling start to rapid cooling stop (° C./s) | Rapid cooling stopping temperature (° C.) | Coiling temperature (° C.) |
|---|---|---|---|---|---|---|---|
| 1 | A | 33 | 910 | 0.15 | 1300 | 660 | Room temperature |
| 2 | A | 42 | 910 | 0.15 | 1300 | 660 | 560 |
| 3 | B | 33 | 910 | 0.15 | 1250 | 660 | Room temperature |
| 4 | B | 33 | 910 | 0.15 | 1250 | 660 | Room temperature |
| 5 | B | 33 | 910 | 0.15 | 1250 | 660 | 560 |
| 6 | C | 42 | 910 | 0.17 | 1150 | 660 | 560 |
| 7 | C | 33 | 910 | 0.17 | 1150 | 660 | Room temperature |
| 8 | D | 42 | 910 | 0.17 | 1100 | 670 | Room temperature |
| 9 | E | 42 | 910 | 0.17 | 1100 | 670 | 560 |
| 10 | E | 33 | 910 | 0.17 | 1100 | 670 | Room temperature |
| 11 | E | 33 | 910 | 0.17 | 1100 | 660 | Room temperature |
| 12 | F | 42 | 910 | 0.15 | 1250 | 650 | 560 |
| 13 | F | 33 | 910 | 0.15 | 1250 | 660 | 560 |
| 14 | G | 33 | 910 | 0.16 | 1200 | 660 | 560 |
| 15 | H | 42 | 910 | 0.15 | 1250 | 650 | 560 |
| 16 | I | 42 | 910 | 0.15 | 1300 | 650 | Room temperature |
| 17 | J | 42 | 910 | 0.17 | 1150 | 660 | 560 |
| 18 | K | 42 | 910 | 0.17 | 1100 | 660 | 560 |
| 19 | L | 42 | 910 | 0.17 | 1150 | 660 | 560 |
| 20 | M | 33 | 910 | 0.17 | 1150 | 660 | 560 |
| 21 | N | 33 | 910 | 0.16 | 1200 | 670 | 600 |
| 22 | O | 33 | 910 | 0.17 | 1100 | 660 | Room temperature |
| 23 | P | 42 | 910 | 0.17 | 1150 | 660 | 560 |
| 24 | Q | 42 | 910 | 0.17 | 1150 | 660 | 560 |
| 25 | R | 42 | 910 | 0.15 | 1250 | 650 | 560 |
| 26 | S | 42 | 910 | 0.17 | 1150 | 660 | 560 |
| 27 | T | 33 | 910 | 0.16 | 1200 | 660 | Room temperature |
| 28 | U * | 22 | 910 | 0.16 | 1200 | 650 | 600 |
| 29 | V | 25 | 890 | 4.03 * | 60 * | 670 | 600 |
| 30 | V | 25 | 890 | 0.23 | 750 | 710 | 600 |
| 31 | W | 25 | 900 | 3.96 * | 70 * | 670 | 600 |
| 32 | W | 25 | 910 | 0.19 | 1000 | 680 | Room temperature |
| 33 | F | 11 * | 900 | 0.15 | 1200 | 640 | 560 |

| Test No. | With or without hot-rolled sheet annealing | Annealing conditions: Soaking temperature (° C.) | Primary cooling stopping temperature (° C./s) | Secondary cooling rate (° C./s) | Cooling stopping temperature (° C.) | Holding time (s) | Galvanneaing temperature (° C.) |
|---|---|---|---|---|---|---|---|
| 1 | With | 870 | 700 | 40 | 425 | 120 | 500 |
| 2 | Without | 850 | 730 | 40 | 425 | 330 | 500 |
| 3 | With | 870 | 700 | 40 | 375 | 60 | 500 |
| 4 | With | 850 | 700 | 40 | 375 | 60 | 500 |
| 5 | Without | 870 | 700 | 40 | 375 | 60 | 500 |
| 6 | Without | 880 | 790 | 40 | 425 | 60 | 500 |
| 7 | With | 880 | 790 | 40 | 425 | 60 | 500 |
| 8 | With | 880 | 790 | 40 | 425 | 60 | 500 |
| 9 | Without | 880 | 790 | 40 | 425 | 60 | 500 |
| 10 | With | 880 | 790 | 40 | 425 | 60 | 500 |
| 11 | With | 880 | 790 | 40 | 425 | 60 | 520 |
| 12 | Without | 850 | 790 | 40 | 425 | 60 | 500 |
| 13 | Without | 860 | 790 | 40 | 400 | 60 | 500 |
| 14 | Without | 890 | 790 | 40 | 425 | 60 | 500 |
| 15 | Without | 850 | 790 | 40 | 400 | 60 | 500 |
| 16 | With | 850 | 700 | 40 | 375 | 330 | 500 |
| 17 | Without | 880 | 790 | 40 | 375 | 60 | 500 |
| 18 | Without | 880 | 790 | 40 | 375 | 60 | 500 |
| 19 | Without | 880 | 790 | 40 | 375 | 60 | 500 |
| 20 | Without | 880 | 790 | 40 | 425 | 60 | 500 |
| 21 | Without | 850 | 670 | 40 | 425 | 330 | 520 |
| 22 | With | 850 | 790 | 40 | 425 | 60 | 500 |
| 23 | Without | 880 | 790 | 40 | 350 | 60 | 500 |
| 24 | Without | 870 | 700 | 40 | 425 | 60 | 500 |
| 25 | Without | 850 | 790 | 40 | 425 | 60 | 500 |
| 26 | Without | 850 | 700 | 40 | 375 | 60 | 500 |
| 27 | With | 870 | 790 | 40 | 425 | 330 | 500 |
| 28 | Without | 850 | 700 | 40 | 400 | 330 | 500 |
| 29 | Without | 850 | 700 | 40 | 350 | 200 | 500 |
| 30 | Without | 780 * | 670 | 40 | 350 | 60 | 500 |

TABLE 2-continued

| | | | | | | | |
|---|---|---|---|---|---|---|---|
| 31 | Without | 850 | 790 | 40 | 350 | 60 | 500 |
| 32 | Without * | 850 | 730 | 40 | 350 | 120 | 500 |
| 33 | Without | 880 | 790 | 40 | 425 | 60 | 500 |

Note)
Symbol * indicates out of the scope of the present invention.

A test specimen for SEM observation was sampled from the annealed steel sheet, and the longitudinal cross sectional surface thereof parallel to the rolling direction was polished and was subjected to Nital etching. Thereafter, the metallurgical structure was observed at a position deep by one-fourth of thickness from the surface of steel sheet, and by image processing, the volume fractions of low-temperature transformation product and polygonal ferrite were measured. Also, the average grain size (circle corresponding diameter) of polygonal ferrite was determined by dividing the area occupied by the whole of polygonal ferrite by the number of crystal grains of polygonal ferrite.

Moreover, a specimen for XRD measurement was taken from the annealed steel sheet, the rolled surface thereof was chemically polished from the surface of the steel sheet to a position at a depth of ¼ sheet thickness, and thereafter subjected to X-ray diffraction test to measure the volume fraction and average carbon concentration of retained austenite. To be specific, RINT 2500 manufactured by Rigaku Corporation was used as the X-ray diffraction apparatus to make Co—Kα rays incident on the specimen, and integrated intensities of (110), (200), and (211) diffraction peaks of a phase, and (111), (200), and (220) diffraction peaks of γ phase were measured to determine the volume fraction of retained austenite. Further, a lattice constant dγ (A) was determined from diffraction angles of the (111), (200), and (220) diffraction peaks of γ phase, and an average carbon concentration Cγ (mass %) of retained austenite was determined from the following conversion formula.

$$C\gamma=(d\gamma-3.572+0.00157\times Si-0.0012\times Mn)/0.033$$

Furthermore, a test specimen for EBSP measurement was sampled from the annealed steel sheet, and the longitudinal cross sectional surface thereof parallel to the rolling direction was electropolished. Thereafter, the metallurgical structure was observed at a position deep by one-fourth of thickness from the surface of steel sheet, and by image analysis, the grain size distribution of retained austenite and the average grain size of retained austenite were measured. Specifically, as an EBSP measuring device, OIM5 manufactured by TSL Corporation was used, electron beams were applied at a pitch of 0.1 μm in a region having a size of 50 μm in the sheet thickness direction and 100 μm in the rolling direction, and among the obtained data, the data in which the reliability index was 0.1 or more was used as effective data to make judgment of fcc phase. With a region that was observed as the fcc phase and was surrounded by a parent phase being made one retained austenite grain, the circle corresponding diameter of individual retained austenite grain was determined. The average grain size of retained austenite was calculated as the mean value of circle corresponding diameters of individual effective retained austenite grains, the effective retained austenite grains being retained austenite grains each having a circle corresponding diameter of 0.15 μm or larger. Also, the number density ($N_R$) per unit area of retained austenite grains each having a grain size of 1.2 μm or larger was determined.

The yield stress (YS) and tensile strength (TS) were determined by sampling a JIS No. 5 tensile test specimen along the direction perpendicular to the rolling direction from the annealed steel sheet, and by conducting a tensile test at a tension speed of 10 mm/min. The total elongation (El) was determined as follows: a tensile test was conducted by using a JIS No. 5 tensile test specimen sampled along the direction perpendicular to the rolling direction, and by using the obtained actually measured value ($El_0$), the converted value of total elongation corresponding to the case where the sheet thickness is 1.2 mm was determined based on formula (1) above. The work hardening coefficient (n-value) was calculated with the strain range being 5 to 10% by conducting a tensile test by using a JIS No. 5 tensile test specimen sampled along the direction perpendicular to the rolling direction. Specifically, the n-value was calculated by the two point method by using test forces with respect to nominal strains of 5% and 10%.

The stretch flangeability was evaluated by performing the Hole Expanding Test specified by the Japan Iron and Steel Federation standard JFST1001 and measuring a hole expanding ratio (λ). A square test piece of 100 mm square was taken from an annealed steel sheet, a punch hole having a diameter of 10 mm was provided at a clearance of 12.5%, and the punch hole was expanded from a rollover side with a conical punch of a top angle of 60° to measure an expansion ratio of the hole when a crack extended through the sheet thickness so that the expansion ratio was adopted as the hole expanding ratio.

Table 3 gives the metallurgical structure observation results and the performance evaluation results of the cold-rolled steel sheet after being annealed. In Tables 1 to 3, mark "*" attached to a symbol or numeral indicates that the symbol or numeral is out of the range of the present invention.

TABLE 3

| | | Metallic structure of cold-relief steel sheet (annealed steel sheet) | | | | | | | Mechanical properties of cold-rolled steel sheet (annealed steel sheet) | |
|---|---|---|---|---|---|---|---|---|---|---|
| Test No. | Steel | Low-temperature transformation phase volume fraction (%) (%) | Martensite volume fraction (%) | Retained austenite volume fraction (%) | Polygonal ferrite volume fraction (%) | Retained austenite average grain size (μm) | Retained austenite carbon concentration (mass %) | $N_R$ (l/μm$^2$) | YS (MPa) | TS (MPa) |
| 1 | A | 84.6 | 3.2 | 14.1 | 1.3 | 0.47 | 0.85 | 0.018 | 718 | 1070 |
| 2 | A | 85.0 | 2.9 | 13.1 | 1.9 | 0.43 | 0.94 | 0.016 | 743 | 1065 |
| 3 | B | 82.4 | 4.6 | 11.7 | 5.9 | 0.57 | 0.88 | 0.010 | 667 | 1021 |

TABLE 3-continued

| | | | | | | | | | | |
|---|---|---|---|---|---|---|---|---|---|---|
| 4 | B | 80.4 | 3.7 | 12.4 | 7.2 | 0.53 | 0.87 | 0.009 | 581 | 1001 |
| 5 | B | 84.5 | 4.0 | 11.0 | 4.5 | 0.50 | 0.90 | 0.010 | 665 | 1020 |
| 6 | C | 81.2 | 2.9 | 11.6 | 7.2 | 0.56 | 0.98 | 0.009 | 607 | 925 |
| 7 | C | 81.4 | 3.2 | 11.4 | 7.2 | 0.51 | 1.02 | 0.008 | 622 | 925 |
| 8 | D | 81.4 | 2.1 | 10.8 | 7.8 | 0.54 | 1.02 | 0.009 | 592 | 886 |
| 9 | E | 79.6 | 3.1 | 10.6 | 9.8 | 0.62 | 1.09 | 0.018 | 501 | 806 |
| 10 | E | 78.9 | 3.5 | 10.7 | 10.4 | 0.59 | 1.02 | 0.016 | 512 | 814 |
| 11 | E | 81.6 | 2.4 | 7.3 | 11.1 | 0.58 | 1.00 | 0.017 | 520 | 809 |
| 12 | F | 79.5 | 3.9 | 12.0 | 8.5 | 0.60 | 0.92 | 0.009 | 613 | 959 |
| 13 | F | 82.5 | 3.1 | 11.0 | 6.5 | 0.54 | 0.97 | 0.008 | 679 | 981 |
| 14 | G | 80.8 | 2.8 | 12.7 | 6.5 | 0.48 | 1.01 | 0.008 | 571 | 933 |
| 15 | H | 84.1 | 4.2 | 13.3 | 2.6 | 0.51 | 0.88 | 0.008 | 687 | 1038 |
| 16 | I | 86.2 | 3.4 | 9.9 | 3.9 | 0.42 | 0.87 | 0.014 | 706 | 1026 |
| 17 | J | 77.4 | 2.7 | 12.2 | 10.4 | 0.48 | 0.95 | 0.008 | 598 | 942 |
| 18 | K | 76.8 | 2.6 | 11.4 | 11.8 | 0.56 | 1.00 | 0.009 | 595 | 905 |
| 19 | L | 83.8 | 2.3 | 9.7 | 6.5 | 0.52 | 0.98 | 0.008 | 629 | 912 |
| 20 | M | 81.8 | 2.8 | 13.0 | 5.2 | 0.49 | 0.96 | 0.011 | 579 | 969 |
| 21 | N | 85.8 | 3.1 | 12.9 | 1.3 | 0.44 | 0.87 | 0.014 | 543 | 980 |
| 22 | O | 85.2 | 3.4 | 10.3 | 4.5 | 0.58 | 0.89 | 0.013 | 632 | 961 |
| 23 | P | 81.6 | 2.2 | 11.2 | 7.2 | 0.53 | 1.02 | 0.009 | 631 | 912 |
| 24 | Q | 83.7 | 3.7 | 11.8 | 4.5 | 0.41 | 0.92 | 0.012 | 644 | 1073 |
| 25 | R | 85.9 | 4.1 | 10.9 | 3.2 | 0.46 | 0.94 | 0.011 | 623 | 982 |
| 26 | S | 85.4 | 4.4 | 10.1 | 4.5 | 0.43 | 0.95 | 0.008 | 611 | 1091 |
| 27 | T | 82.6 | 3.7 | 12.2 | 5.2 | 0.59 | 0.89 | 0.010 | 670 | 973 |
| 28 | U* | 89.3 | 2.4 | 3.0* | 7.7 | 0.85* | 0.69 | 0.008 | 549 | 718 |
| 29 | V | 76.9 | 5.9 | 8.9 | 14.2 | 0.83* | 0.82 | 0.037* | 506 | 992 |
| 30 | V | 44.2* | 6.1 | 7.2 | 48.6 | 0.82* | 0.84 | 0.043* | 489 | 1032 |
| 31 | W | 76.1 | 6.9 | 8.1 | 15.8 | 0.73 | 0.81 | 0.038* | 526 | 1037 |
| 32 | W | 78.1 | 6.2 | 9.0 | 12.9 | 0.72 | 0.85 | 0.036* | 501 | 1051 |
| 33 | F | 89.9 | 4.8 | 7.1 | 3.0 | 0.74 | 0.80 | 0.040* | 468 | 1026 |

| | Mechanical properties of cold-rolled steel sheet (annealed steel sheet) | | | | | | | | |
|---|---|---|---|---|---|---|---|---|---|
| Test No. | El (%) | n value | λ (%) | TS × E1 (MPa %) | TS × n value (MPa) | $TS^{1.7} \times \lambda$ ($MPa^{1.7}$%) | (TS × El) × 7 × $10^3$ + ($TS^{1.7} \times \lambda$) × 8 | Yield ratio YR | Remarks |
| 1 | 20.5 | 0.164 | 45.9 | 21935 | 175 | 6482837 | 205407697 | 0.67 | ○ |
| 2 | 19.2 | 0.167 | 54.2 | 20434 | 178 | 7594403 | 203794603 | 0.70 | ○ |
| 3 | 21.2 | 0.167 | 50.8 | 21645 | 171 | 6625329 | 204519035 | 0.65 | ○ |
| 4 | 22.2 | 0.193 | 52.5 | 22217 | 193 | 6620598 | 208483315 | 0.58 | ○ |
| 5 | 20.7 | 0.168 | 55.1 | 21114 | 171 | 7174174 | 205191390 | 0.65 | ○ |
| 6 | 24.1 | 0.188 | 52.2 | 22257 | 174 | 5755876 | 201845774 | 0.66 | ○ |
| 7 | 23.3 | 0.182 | 56.5 | 21585 | 168 | 6230019 | 200938093 | 0.67 | ○ |
| 8 | 25.6 | 0.192 | 59.6 | 22697 | 170 | 6107783 | 207740702 | 0.67 | ○ |
| 9 | 29.6 | 0.230 | 64.9 | 23824 | 185 | 5662579 | 212069196 | 0.62 | ○ |
| 10 | 28.3 | 0.224 | 63.0 | 23047 | 182 | 5589874 | 206051300 | 0.63 | ○ |
| 11 | 27.7 | 0.212 | 75.6 | 22409 | 172 | 6637955 | 209968737 | 0.64 | ○ |
| 12 | 22.6 | 0.180 | 51.6 | 21683 | 173 | 6049804 | 200176632 | 0.64 | ○ |
| 13 | 21.1 | 0.159 | 69.9 | 20654 | 156 | 8517546 | 212717410 | 0.69 | ○ |
| 14 | 25.2 | 0.203 | 50.0 | 23514 | 189 | 5594597 | 209353885 | 0.61 | ○ |
| 15 | 21.6 | 0.175 | 51.1 | 22392 | 181 | 6854194 | 211579016 | 0.66 | ○ |
| 16 | 21.1 | 0.162 | 55.1 | 21601 | 166 | 7246063 | 209177521 | 0.69 | ○ |
| 17 | 24.5 | 0.194 | 57.2 | 23057 | 183 | 6505528 | 213441871 | 0.63 | ○ |
| 18 | 25.8 | 0.191 | 59.7 | 23371 | 173 | 6342740 | 214341512 | 0.66 | ○ |
| 19 | 23.3 | 0.175 | 70.3 | 21282 | 160 | 7567398 | 209513581 | 0.69 | ○ |
| 20 | 23.6 | 0.195 | 49.8 | 22914 | 189 | 5942645 | 207936928 | 0.60 | ○ |
| 21 | 22.7 | 0.189 | 51.4 | 22259 | 185 | 6252410 | 205832563 | 0.55 | ○ |
| 22 | 23.9 | 0.177 | 47.4 | 22968 | 170 | 5577096 | 205392066 | 0.66 | ○ |
| 23 | 23.0 | 0.175 | 70.7 | 20976 | 160 | 7610455 | 207715642 | 0.69 | ○ |
| 24 | 19.6 | 0.161 | 48.7 | 21031 | 173 | 6911121 | 202504567 | 0.60 | ○ |
| 25 | 22.3 | 0.182 | 52.1 | 21899 | 179 | 6359563 | 204166701 | 0.63 | ○ |
| 26 | 19.8 | 0.174 | 43.5 | 21602 | 190 | 6350257 | 202014660 | 0.56 | ○ |
| 27 | 22.8 | 0.189 | 64.0 | 22184 | 184 | 7690805 | 216817240 | 0.69 | ○ |
| 28 | 24.1 | 0.175 | 48.0 | 17304 | 126 | 3440747 | 148652579 | 0.76 | x |
| 29 | 16.9 | 0.149 | 34.4 | 16765 | 148 | 4271971 | 151529367 | 0.51 | x |
| 30 | 17.3 | 0.167 | 28.7 | 17854 | 172 | 3811864 | 155470111 | 0.47 | x |
| 31 | 16.1 | 0.142 | 29.8 | 16696 | 147 | 3990618 | 148794843 | 0.51 | x |
| 32 | 15.2 | 0.141 | 26.4 | 15975 | 148 | 3616834 | 140761070 | 0.48 | x |
| 33 | 20.1 | 0.143 | 27.2 | 20623 | 147 | 3577004 | 172974231 | 0.46 | x |

(Note)

$N_R$: Number density of retained austenite grains whose grain size is 1.2 μm or more; El is total elongation converted to sheet thickness 1.2 mm, λ is hole expanding rate, n value is work hardening coefficient; ○: Inventive example, x: Comparative example Symbol * indicates out of the scope of the present invention.

Any of the test results (Test Nos. 1 to 27) of steel sheets which were within the scope of the present invention showed a value of TS×El of 18000 MPa or more, a value of TS×n-value of 150 or more, a value of $TS^{1.7}\times\lambda$ of 4500000 $MPa^{1.7}$% or more, and a value of $(TS\times El)\times7\times10^3+(TS^{1.7}\times\lambda)\times8$ of $180\times10^6$ or more, thus exhibiting excellent ductility, work hardenability, and stretch flangeability.

The test results (Test Nos. 28 to 33) of steel sheets whose metallurgical structures were out of the scope specified by the present invention showed poor performance in at least one of ductility, work hardenability, and stretch flangeability.

The invention claimed is:

1. A hot-dip galvanized cold-rolled steel sheet having a hot-dip galvanized layer on a surface of a cold-rolled steel sheet, the cold-rolled steel sheet comprising:

a chemical composition consisting of, in mass percent, C: more than 0.10% and less than 0.25%, Si: more than 0.70% and less than 2.0%, Mn: more than 1.50% and at most 3.0%, P: less than 0.050%, S: at most 0.010%, sol. Al: at least 0% and less than 0.10%, N: at most 0.010%, Ti: at least 0% and less than 0.040%, Nb: at least 0% and less than 0.030%, V: at least 0% and at most 0.50%, Cr: at least 0% and at most 1.0%, Mo: at least 0% and less than 0.20%, B: at least 0% and at most 0.010%, Ca: at least 0% and at most 0.010%, Mg: at least 0% and at most 0.010%, REM: at least 0% and at most 0.050%, Bi: at least 0% and at most 0.050%, and the remainder being Fe and impurities; and a metallurgical structure in which a main phase is a low-temperature transformation product and a second phase contains retained austenite, wherein the retained austenite has a volume fraction of more than 4.0% to less than 25.0% with respect to a whole structure, and an average grain size of less than 0.80 μm, and in the retained austenite, a number density of retained austenite grains having a grain size of 1.2 μm or more is $3.0\times10^{-2}/\mu m^2$ or less.

2. The hot-dip galvanized cold-rolled steel sheet as set forth in claim 1, wherein the chemical composition contains, in mass percent, one kind or two or more kinds selected from a group consisting of Ti: at least 0.005% and less than 0.040%, Nb: at least 0.005% and less than 0.030%, and V: at least 0.010% and at most 0.50%.

3. The hot-dip galvanized cold-rolled steel sheet as set forth in claim 1, wherein the chemical composition contains, in mass percent, one kind or two or more kinds selected from a group consisting of Cr: at least 0.20% and at most 1.0%, Mo: at least 0.05% and less than 0.20%, and B: at least 0.0010% and at most 0.010%.

4. The hot-dip galvanized cold-rolled steel sheet as set forth in claim 1, wherein the chemical composition contains, in mass percent, one kind or two or more kinds selected from a group consisting of Ca: at least 0.0005% and at most 0.010%, Mg: at least 0.0005% and at most 0.010%, REM: at least 0.0005% and at most 0.050%, and Bi: at least 0.0010% and at most 0.050%.

5. The hot-dip galvanized cold-rolled steel sheet as set forth in claim 1, wherein the chemical composition contains, in mass percent, C: more than 0.12% and less than 0.25%.

6. A method for manufacturing a hot-dip galvanized cold-rolled steel sheet according to claim 1, comprising the following steps (A)-(D):

(A) a hot-rolling step in which a slab having the chemical composition consisting of, in mass percent, C: more than 0.10% and less than 0.25%, Si: more than 0.70% and less than 2.0%, Mn: more than 1.50% and at most 3.0%, P: less than 0.050%, SL at most 0.010%, sol. Al: at least 0% and less than 0.10%, N: at most 0.010%, Ti: at least 0% and less than 0.040%, Nb: at least 0% and less than 0.030%, V: at least 0% and at most 0.50%, Cr: at least 0% and at most 1.0%, Mo: at least 0% and less than 0.20%, B: at least 0% and at most 0.010%, Mg: at least 0% and at most 0.010%, REM: at least 0% and at most 0.050%, Bi: at least 0% and at most 0.050%, and the remainder being Fe and impurities is subjected to hot rolling in which a final pass reduction is more than 15% and rolling is completed in a temperature condition meeting both of ($Ar_3$ point+30° C.) or higher and higher than 880° C. to form a hot-rolled steel sheet, and the hot-rolled steel sheet is cooled to a temperature range of 720° C. or lower within 0.40 seconds after the completion of the rolling, and is coiled in a temperature range of higher than 400° C.;

(B) a cold-rolled step in which the coiled hot-rolled steel sheet is uncoiled and subjected to a cold rolling to form a cold-rolled steel sheet;

(C) an annealing step in which the cold-rolled steel sheet is subjected to soaking treatment in a temperature range of higher than $Ac_3$ point, thereafter is cooled to a temperature range of 340° C. to 450° C., and is held for 15 seconds or more in the same temperature range to form an annealed cold-rolled sheet; and (D) a hot-dip galvanizing step in which the annealed cold-rolled steel sheet is subjected to hot-dip galvanizing.

7. A method for producing a hot-dip galvanized cold-rolled steel sheet according to claim 1, comprising the following steps (a) to (e):

(a) a hot-rolling step in which a slab having the chemical composition consisting of, in mass percent, C: more than 0.10% and less than 0.25%, Si: more than 0.70% and less than 2.0%, Mn: more than 1.50% and at most 3.0%, P: less than 0.050%, S: at most 0.010%, sol. Al: at least 0% and less than 0.10%, N: at most 0.010%, Ti: at least 0% and less than 0.040%, Nb: at least 0% and less than 0.030%, V: at least 0% and at most 0.50%, Cr: at least 0% and at most 1.0%, Mo: at least 0% and less than 0.20%, B: at least 0% and at most 0.010%, Ca: at least 0% and at most 0.010%, Mg: at least 0% and at most 0.010%, REM: at least 0% and at most 0.050%, Bi: at least 0% and at most 0.050%, and the remainder being Fe and impurities is subjected to hot rolling in which a final pass reduction is more than 15% and rolling is completed in a temperature condition meeting both of (Ar3 point+30° C.) or higher, and higher than 880° C. to form a hot-rolled steel sheet, and the hot-rolled steel sheet is cooled to a temperature range of 720° C. or lower within 0.40 seconds after the completion of the rolling, and is coiled in a temperature range of lower than 200° C.;

(b) a hot-rolled sheet annealing step in which the coiled hot-rolled steel sheet is uncoiled and subjected to annealing in a temperature range of 500° C. or higher, and lower than $Ac_1$ point to form an annealed hot-rolled steel sheet;

(c) a cold-rolling step in which the annealed hot-rolled steel sheet is subjected to cold rolling to form a cold-rolled steel sheet;

(d) an annealing step in which the cold-rolled steel sheet is subjected to soaking treatment in a temperature range of higher than $Ac_3$ point, thereafter is cooled to a temperature range of 340° C. to 450° C., and is held for 15 seconds or more in the temperature range to form an annealed cold-rolled steel sheet; and (e) a hot-dip galvanizing step in which the annealed cold-rolled steel sheet is subjected to hot-dip galvanizing.

* * * * *